US011319123B2

(12) United States Patent
Wolfe

(10) Patent No.: US 11,319,123 B2
(45) Date of Patent: May 3, 2022

(54) DRINKING VESSEL WITH UTENSIL COMPARTMENT ACCESSIBLE THROUGH A TOP LID

(71) Applicant: Ryan Wolfe, Orlando, FL (US)

(72) Inventor: Ryan Wolfe, Orlando, FL (US)

( * ) Notice: Subject to any disclaimer, the term of this patent is extended or adjusted under 35 U.S.C. 154(b) by 55 days.

(21) Appl. No.: 16/688,477

(22) Filed: Nov. 19, 2019

(65) Prior Publication Data

US 2021/0147128 A1 May 20, 2021

(51) Int. Cl.
*B65D 51/24* (2006.01)
*B65D 81/32* (2006.01)

(52) U.S. Cl.
CPC ..... *B65D 51/246* (2013.01); *B65D 81/3216* (2013.01)

(58) Field of Classification Search
CPC ..... A47G 19/2205; A47G 19/22; A47G 19/2222; A47G 19/2266; A47G 19/30; A47G 21/145; A45F 3/16; B65D 1/04; B65D 23/00; B65D 81/3216; B65D 81/32; B65D 51/04; B65D 50/00; B65D 51/246; A61J 7/0046
USPC .... 206/217, 766, 216, 218; 215/6, 386, 390, 215/388, 387; 220/527, 253, 256.1, 254.2
See application file for complete search history.

(56) References Cited

U.S. PATENT DOCUMENTS 3,624,787 A 11/1971 Newman
3,679,093 A 7/1972 Chang
4,573,631 A * 3/1986 Reeves ..... B65D 77/283 220/710
4,921,120 A * 5/1990 Mizioch ..... F16L 43/00 220/254.2
4,930,637 A 6/1990 Deroseau
5,042,712 A 8/1991 Deroseau
5,090,572 A 2/1992 Deroseau
5,705,212 A 1/1998 Atkinson
5,934,501 A * 8/1999 Wright ..... B65D 81/3216 220/528
5,992,667 A 11/1999 Huang
6,170,490 B1 * 1/2001 Barrow ..... A24F 19/0064 131/235.1
6,691,901 B2 * 2/2004 Parve ..... B65D 47/0847 215/245
7,820,214 B2 * 10/2010 Groenke ..... A47G 19/02 426/115
9,301,545 B2 * 4/2016 Li ..... A24F 15/01
9,371,162 B2 * 6/2016 Walunis ..... B65D 47/0847
10,993,559 B2 * 5/2021 Wolfe ..... A47G 19/2205
(Continued)

FOREIGN PATENT DOCUMENTS

CN 201480401 5/2010
CN 103263190 8/2013

*Primary Examiner* — Rafael A Ortiz
(74) *Attorney, Agent, or Firm* — Mark Young, P.A.

(57) ABSTRACT

A drinking vessel with a hidden utensil compartment includes a cup with a recessed side extending from the top to a transition above the bottom. The cup is received in and contained in a cover. The cover and recessed side define a utensil compartment. A drawer holding utensils fits into the utensil compartment. A drawer stop attached to the recessed side includes a spring to facilitate removal of the drawer. A removable lid with movable panels selectively covers or exposes the drinking compartment and the utensil compartment. An optional removable handle may plug into the cover.

17 Claims, 17 Drawing Sheets

(56) References Cited

U.S. PATENT DOCUMENTS

| | | | | |
|---|---|---|---|---|
| 2001/0002673 | A1 | 6/2001 | Huang | |
| 2002/0108952 | A1* | 8/2002 | Delman | B65D 51/246 220/212 |
| 2012/0099393 | A1* | 4/2012 | Portman | B65D 81/3216 366/182.1 |
| 2012/0285845 | A1* | 11/2012 | Jackson | A47G 19/186 206/223 |
| 2017/0349329 | A1* | 12/2017 | McCarthy | A47G 19/2205 |
| 2019/0328163 | A1* | 10/2019 | Grytsenko | B65D 81/022 |

* cited by examiner

DRINKING VESSEL WITH UTENSIL COMPARTMENT ACCESSIBLE THROUGH A TOP LID

FIELD OF THE INVENTION

This invention relates generally to drinking vessels, and, more particularly, to a vessel with a hidden utensil compartment accessible from the top of the container.

BACKGROUND

The countless items of plastic waste polluting oceans, lakes, and rivers and piling up on land is more than unsightly, it is harmful to plants and wildlife. Single-use plastics, such as straws, utensils and plastic bottles, comprise a significant part of the pollution.

World plastics production increased from about an estimated 200 million metric tons in 2002 to 348 million metric tons in 2017, and continues to increase. Roughly half of annual plastic production is destined for single-use products, which include plastic straws, bottles, cups and utensils. Only a small portion is ever recycled, with the balance ending up in landfills, oceans, and elsewhere.

As one example, more than 480 billion plastic drinking bottles were sold in 2016 across the world, up from about 300 billion a decade ago. By 2021 this amount is expected to increase to 583.3 billion. Most plastic bottles used for beverages are made from polyethylene terephthalate (PET), which is highly recyclable. But as their use soars, efforts to collect and recycle the bottles are failing to keep up. Fewer than half of the bottles are collected for recycling and a small percentage of those collected are turned into new bottles. Most plastic bottles produced end up in landfill or in the ocean. The percentages of plastic straws, cups and utensils that are collected and recycled are even lower. As these items tend to be discarded as trash, with other food waste.

Efforts have been made to devise containers with a compartment for storing utensils. Cups or similar containers with a lid having a storage compartment in which one or more utensils are contained are describe in U.S. Pat. Nos. 3,624,787, 3,679,093, 4,930,637, 5,042,712, 5,090,572, 5,705,212 and 5,992,667 and US Patent Application Publication 20010002673. Many of these are disposable cups or containers packaged with disposable utensils. They are part of the problem. They do not provide a means for storing utensils in a cup while the cup is used and remains fully functional. They do not provide means for removing, restoring and securing the utensils in a separate compartment. They do not solve the problem of single use disposable plastic utensils and cups.

A cup with a compartment for holding utensils should allow use of the cup while the utensils are stored or removed. Such a cup should store the utensils in a compartment apart from the beverage compartment of the cup. The compartment containing the utensils should not interfere with use of the cup. Such a cup should securely hold the utensils, preventing rattling of the utensils when the cup is moved. The compartment containing the utensils should include a closure to prevent soiling and contamination. The utensils should be easy to remove from the compartment. Used utensils should be storable in the compartment without soiling the compartment.

The invention is directed to overcoming one or more of the problems and solving one or more of the needs as set forth above.

SUMMARY OF THE INVENTION

To solve one or more of the problems set forth above, in an exemplary implementation of the invention, a drinking vessel assembly includes a compartment for storing utensils. The assembly includes a drinking cup with a recessed side, an outer cover, a drawer and utensils. The drinking cup is received in the outer cover. The compartment is defined and disposed between the recessed side of the drinking cup and the outer cover. The compartment has a generally D-shaped section.

A lid is provided on the drinking vessel assembly. Movable panels on the lid can be moved (e.g., pivoted) to a closed or open position. In the closed position, a panel covers a compartment, such as a beverage compartment or a utensil compartment. In the open position, the panel exposes the compartment, such as a beverage compartment or a utensil compartment. In one embodiment, each movable panel is a pivoting panel that can pivot from a closed position covering the compartment to an open position exposing the compartment. In one embodiment, a panel is provided for each compartment.

A drawer is sized and shaped to receive the utensils and slide into the utensil compartment through an opening accessible through the cover. Utensils are stored in a drawer. Edges of the utensils are retained in flexible tabs in the drawer. The utensils may be a fork, a spoon, a knife, a straw, chopsticks or other eating or drinking utensil. The drawer may include a drawer panel having a top end and a bottom end, a top flange extending orthogonally from the top end of the drawer panel, and a bottom flange extending orthogonally from the bottom end of the drawer panel. The drawer may further include a pair of side flanges perpendicular to the top flange and the bottom flange. When retained in the drawer, the utensils contact the interior of the drawer, but do not contact the walls of the compartment. Thus, a used utensil will not soil the compartment. The drawer and utensils may be removed for use of the utensils and for cleaning of the utensils and drawer.

To facilitate insertion into the compartment and removal from the compartment, a drawer stop with a compression spring (e.g., leaf or coil spring) is provided in the compartment at a distance from the top opening at least as great as the length of the drawer. The drawer cannot be inserted beyond the stop. The spring applies a force against the inserted drawer. The force urges the drawer towards the top opening. When a panel for the utensil compartment is moved to the open position, the spring urges the drawer out of the compartment until the spring has reached its fully extended (uncompressed) position. When the panel is moved to the closed position, the spring urges the drawer against the panel, which causes friction that helps keep the panel in the closed position. Other elements, such as a detent, may help keep the panel in an open position and/or closed position until overcome by sufficient force.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

A drinking vessel assembly 100 according to principles of the invention includes a compartment for storing utensils. The assembly includes a drinking cup with a recessed side, an outer cover, a lid, a compartment, a drawer and utensils. The drinking cup is received in the outer cover.

Figure 1:
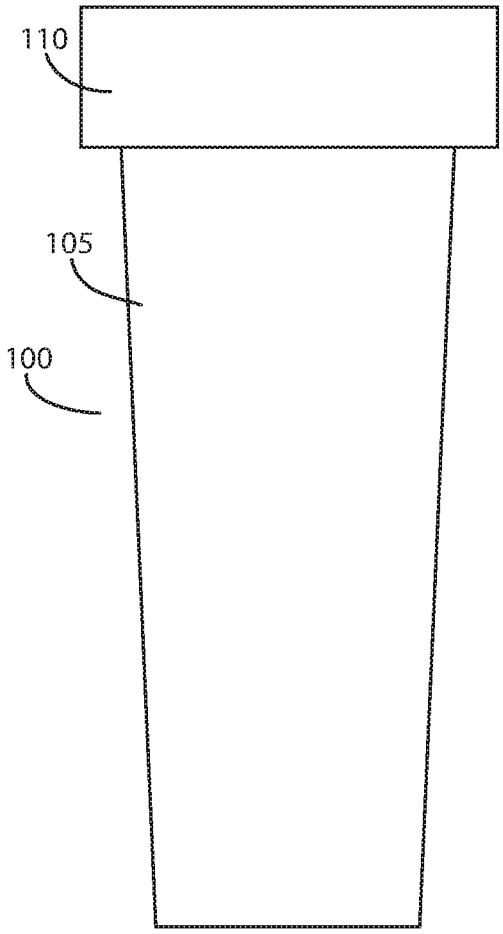
FIG. 1 is a side view of an exemplary drinking vessel according to principles of the invention.
Figure 3:
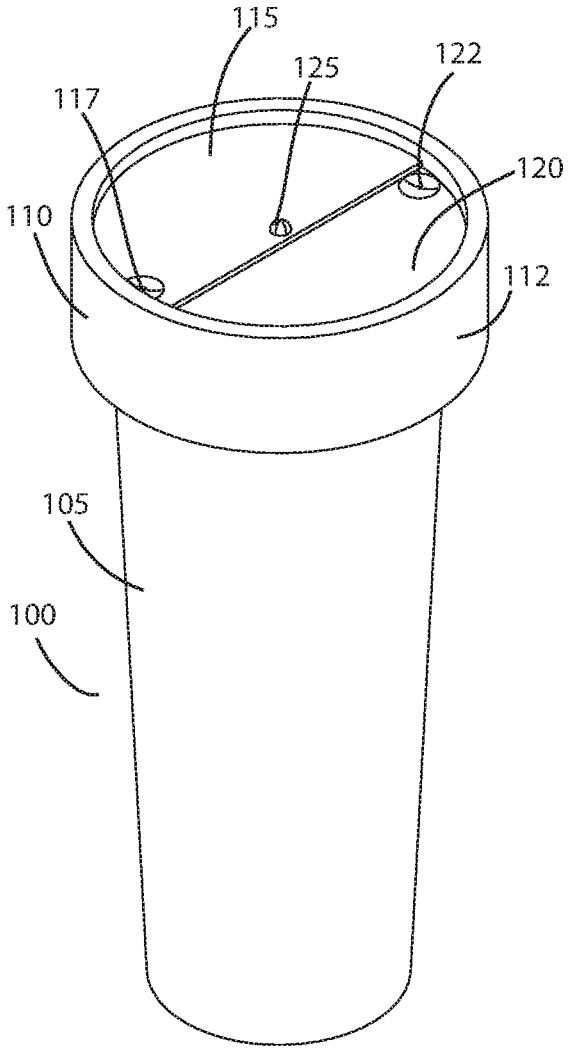
FIG. 3 is a perspective view of an exemplary drinking vessel according to principles of the invention.
Figure 4:
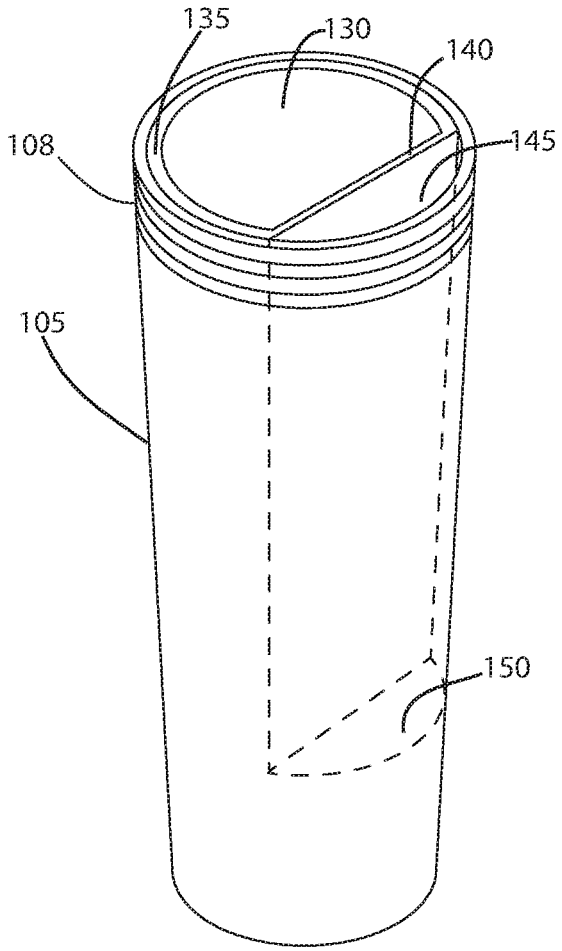
FIG. 4 is a perspective view of a drinking cup with a recessed side contained in an outer cover, according to principles of the invention.
Figure 8:
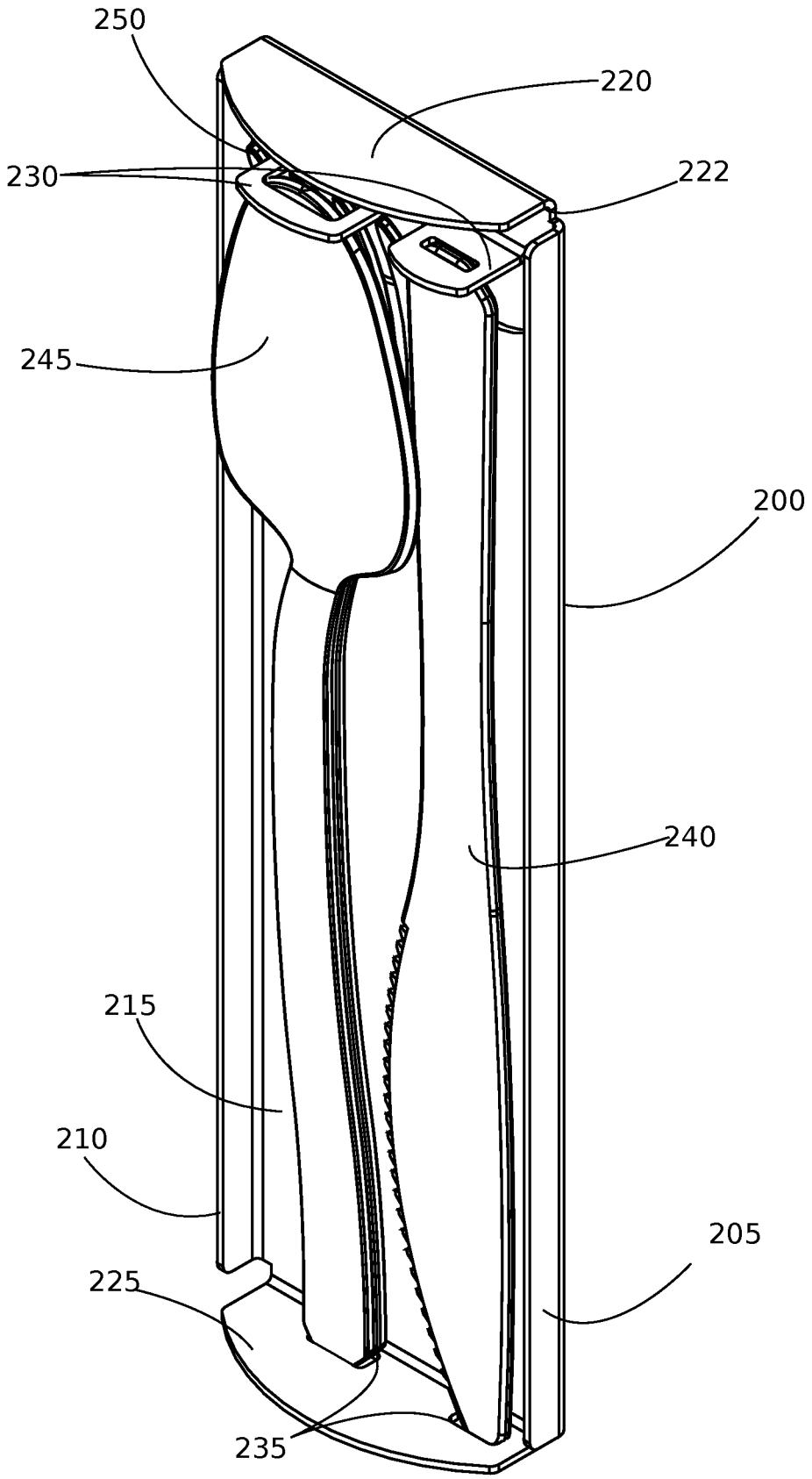
FIG. 8 is a perspective view of a drawer with stored utensils for a drinking vessel according to principles of the invention.
Figure 9:
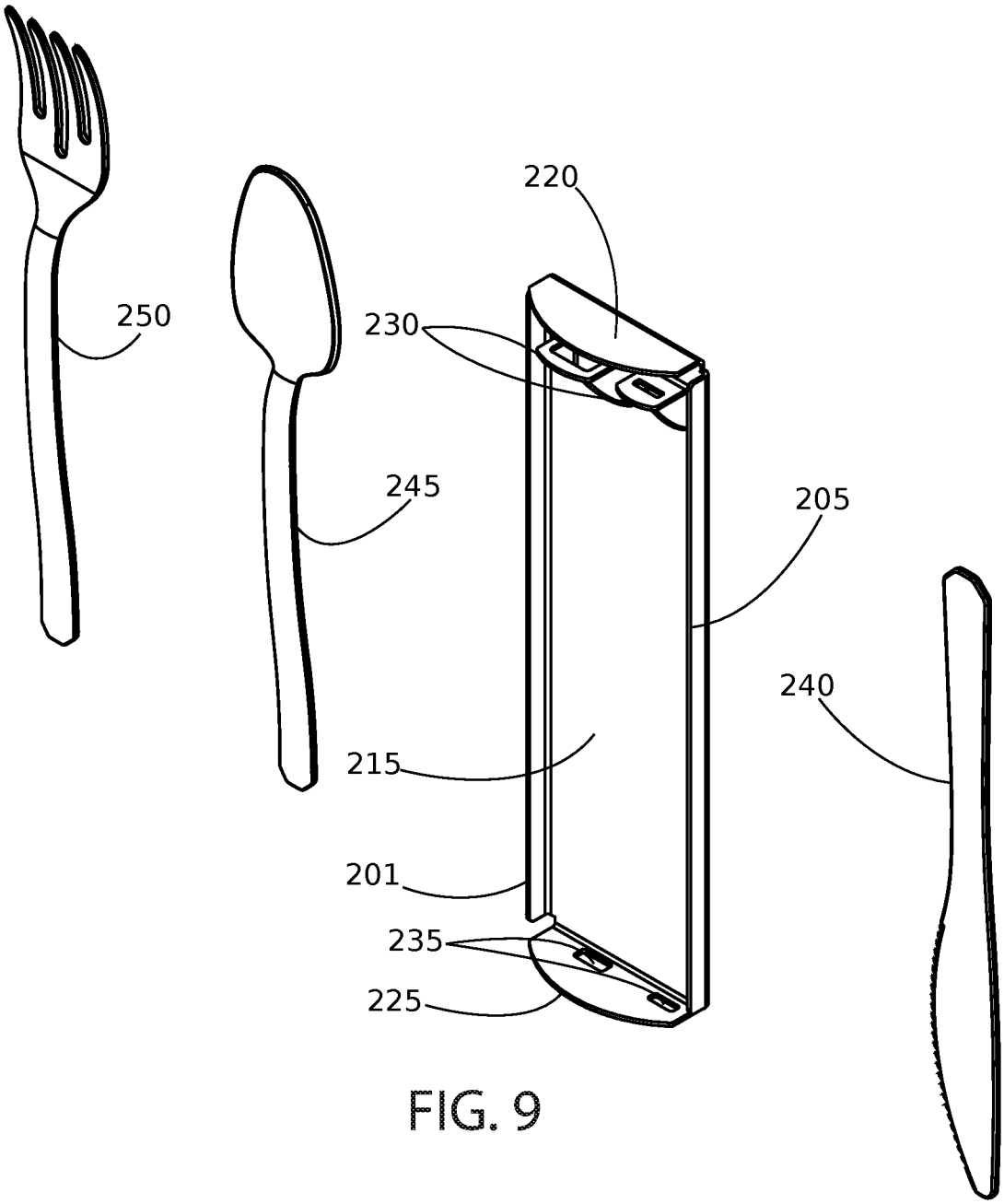
FIG. 9 is an exploded view of a drawer and utensils for a drinking vessel according to principles of the invention.

FIGS. 1 and 3 conceptually illustrate the outer cover 105. The outer cover 105 is a hollow frustum with a larger diameter at the top 106 than at the bottom 107 (FIG. 4). The top 106 of the cover 105 is open. The cover 105 provides a housing to contain the drinking cup 135 (FIG. 4), drawer 200 (FIG. 8) and utensils 240-250 (FIG. 9). The inner diameter of the cover 105 at the top 106 is about the same as the outer diameter of the cup 135 at the top. The inner diameter of the cover 105 at the bottom 107 is about the same as the outer diameter of the cup 135 at the bottom. The length of the cover 105 from top 106 to bottom 107 is about the same or slightly greater than the length of the cup 135 from the top to the bottom, allowing the cup 135 to be contained in the cover 105.

Figure 2:
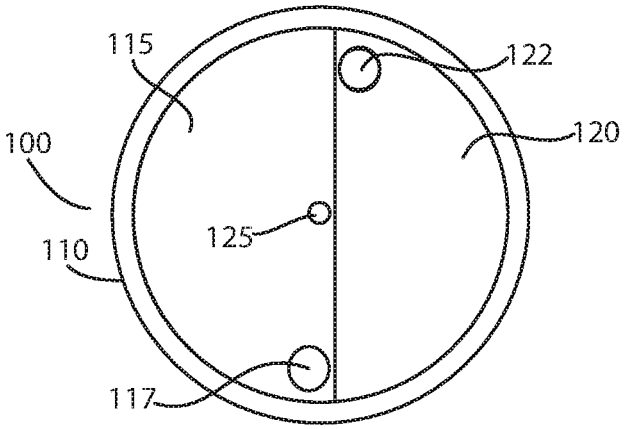
FIG. 2 is a plan view of an exemplary drinking vessel according to principles of the invention.

With reference to FIG. 2, a lid 110 is attached at the top of the assembly 100. The lid 110 is removable. The exemplary lid includes a pair of pivoting panels 115, 120. The panels pivot about pin 125. Fingertip recesses 117, 122 are provided to facilitate manipulation with a finger. The lid 110 may be slid onto or threaded onto the outer cover 105. The panels 115, 120 may be pivoted from the closed position, as shown, to an open position that exposes the space beneath the panel. In a preferred embodiment, one panel 115 covers the utensil compartment 145 (FIG. 4), while the other panel 120 covers the With reference to FIGS. 4 and 5, the drinking cup 135 includes walls 138, 140 that define a beverage compartment 130. In a nonlimiting exemplary embodiment, the drinking cup 135 may be a double-walled vessel. By way of example and not limitation, the drinking cup 135 may be a double-walled stainless-steel vessel, with insulation, evacuated space, air or another gas between the walls. Alternatively, the drinking cup may 135 be single walled. As another alternative, the drinking cup 135 may be comprised of glass or a plastic that is safe for food contact. Nonlimiting examples of such plastics include polyethylene terephthalate, high density polyethylene, low density polyethylene and polypropylene.

Figure 5:
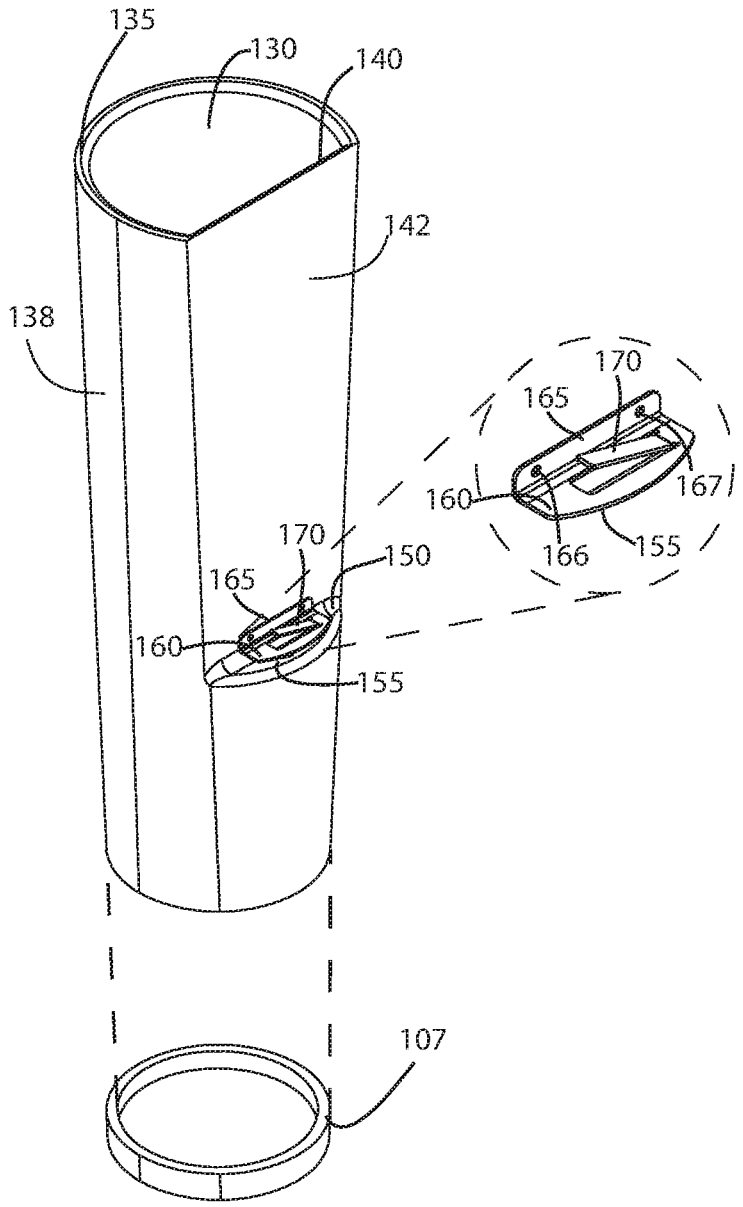
FIG. 5 is a perspective view of a drinking cup with a recessed side and a drawer stop with a leaf spring, according to principles of the invention.

As shown in FIGS. 4 and 5, the drinking cup 135 includes a recessed exterior side 142 along wall 140 of the cup 135. The recessed exterior side 142 of the drinking cup 135 and the outer cover 105 define a space 145 for receiving a utensil drawer 200 (FIGS. 8 and 9). The bottom 107 (FIG. 3) of the drinking cup 135 is not recessed and has a circular cross-section shape. The portion of the drinking cup 135 with the recessed side 142 has a cross-section shape defined by an arc with a chord extending between endpoints of the arc, the chord corresponding to the recessed exterior side 142. As the top 106 of the cup 135 is recessed, a user may drink from any side of the cup 135, except the recessed side 142.

In the exemplary embodiment shown in the FIGS. 4 and 5, the cup 135 transitions 150 from non-recessed to recessed about 10% to 20% of the total height of the cup 135 above the bottom 107 of the cup 135. The recessed side 142 continues from the transition 150 to the top 106 of the cup 135. The point at which the transition 150 is made, the shape of the transition 150, and the depth of the recess may vary considerably within the scope of the invention. The point at which the transition 150 is made, the shape of the transition, and the depth of the recess may be determined to facilitate manufacture and assembly while providing sufficient space to receive a compartment 145 for storing a drawer containing utensils. By way of example and not limitation, the transition 150 may comprise a sharp bend or a bend with a radius as illustrated in FIG. 5.

The bottom 107 of the cup 135 may be a separate piece attached to the cup 135, as conceptually illustrated in FIG. 5. The bottom may be attached by bonding or welding (e.g., ultrasonic welding). A cup 135 with an open bottom may facilitate release from a mold during manufacture. Alternatively, the cup 135 may be integrally formed.

When assembled, the drinking cup 135 is inserted into the outer cover 105. The drinking cup 135 may be frictionally held in the outer cover 105. In such an embodiment the cup 135 may be pressed in the cover 105. In another embodiment, the cup 135 may be bonded in the outer cover 105. In yet another embodiment, the bottom 107 of the cup 135 may be mechanically secured to the bottom of the outer cover, such as with screws or snap fit fasteners that do not penetrate the cup 135 into the beverage compartment 130.

As shown in FIG. 5, the recessed side 142 of the drinking cup 135 includes a drawer stop 155. The drawer stop 155 limits insertion of drawer 200 into the compartment 145. The top 152 (FIG. 4) of the compartment 145 is open. The drawer stop 155 may be attached to the recessed side 142 of the drinking cup 135 at a point about equal to the bottom of the compartment 145, or slightly higher. The bottom end of the drawer 200 may extend to the drawer stop 155.

Figure 10:
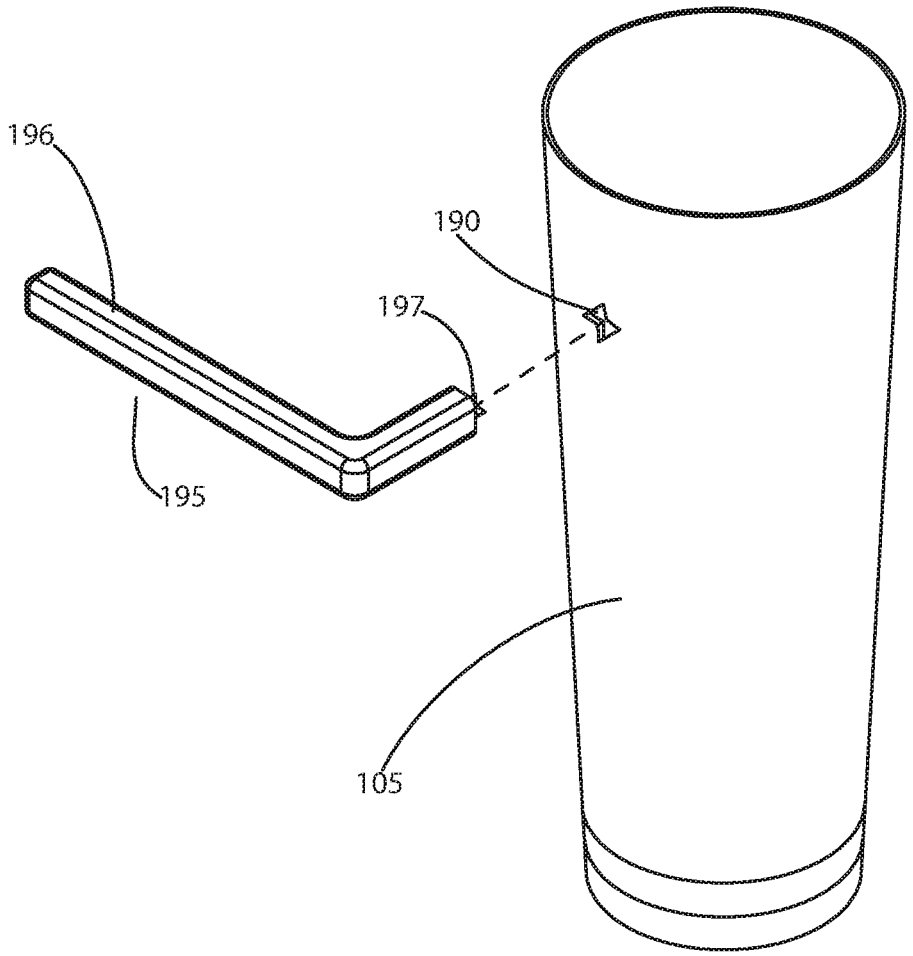
FIG. 10 is a first perspective view of an outer cover with a removable handle for a drinking vessel according to principles of the invention.

FIG. 10 conceptually illustrates an interior compartment of the cup 135. The cup may contain a liquid substance such as a beverage or soup. The interior section 111 coincides with the transition 150. The interior section 113 coincides with the recessed portion 130. The interior bottom 114 corresponds to the bottom 128 of the cup 135.

An exemplary drawer stop 155 is right angled structure, with a vertical panel 165 fastened to the recessed side 142 of the drinking cup 135. A horizontal panel 120 defines the limit of drawer 200 insertion. In the exemplary embodiment, a compression spring such as a leaf spring 170 is formed in the horizontal panel 120 by a U-shaped cut in the panel, with the inner piece forming the spring 170 being bent upwardly, extending above the horizontal panel 120, towards the vertical panel 165. The drawer 200 cannot be inserted beyond the stop 155. The spring 170 applies a force against the inserted drawer 200. The force urges the drawer 200 towards the opening. The stop 155 may be formed of metal or plastic. When the panel 120 is moved to the closed position, the spring urges the drawer 200 against the panel 120, which causes friction that helps keep the panel in the closed position. Other elements, such as a detent, may help keep the panel in an open position and/or closed position until overcome by sufficient force.

The stop 155 is attached to the recessed side 142 of the cup 135. In FIG. 8 a plurality of mounting holes 149 are provided in the outer wall of the double-walled cup 135. Screws may be threaded into a pair of holes 166, 167 to secure the stop 155 to the cup 135 at a position that allows the drawer 200 to be inserted fully into the compartment 145. Fasteners (i.e., attachments) other than screws, such as, but not limited to snap fit connections, rivets, welds and glue may be used in addition to or in lieu of screws. Full insertion, as used herein, is achieved, when the drawer 200 is inserted into the compartment, with the bottom of the drawer 200 being contained in the compartment and against the stop 155.

As shown in FIG. 4, the exemplary compartment 145 has a hollow D-shaped cross-sectional shape (i.e., the compartment defined by the elongated hollow structure has a D-shaped cross-section). Such a shape is preferred because it provides a generally planar side to abut the recessed side 142 of the cup 135 and a curved side that does not extend outwardly beyond the maximum outer diameter of the cup 135. Thus, the outer cover 105 does not require any outwardly bulging cavity to accommodate the compartment 145 in the space 135 between the outer cover 105 and the recessed side 142.

Figure 6:
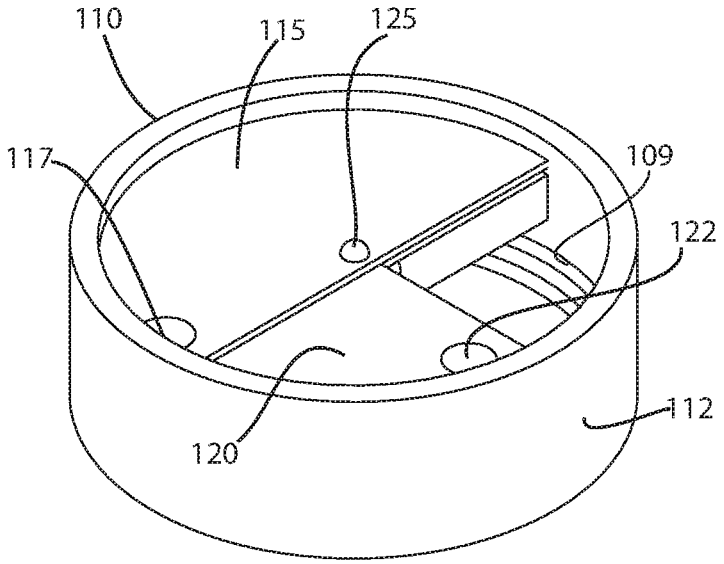
FIG. 6 is a perspective view of an exemplary lid for a drinking vessel, according to principles of the invention.
Figure 7:
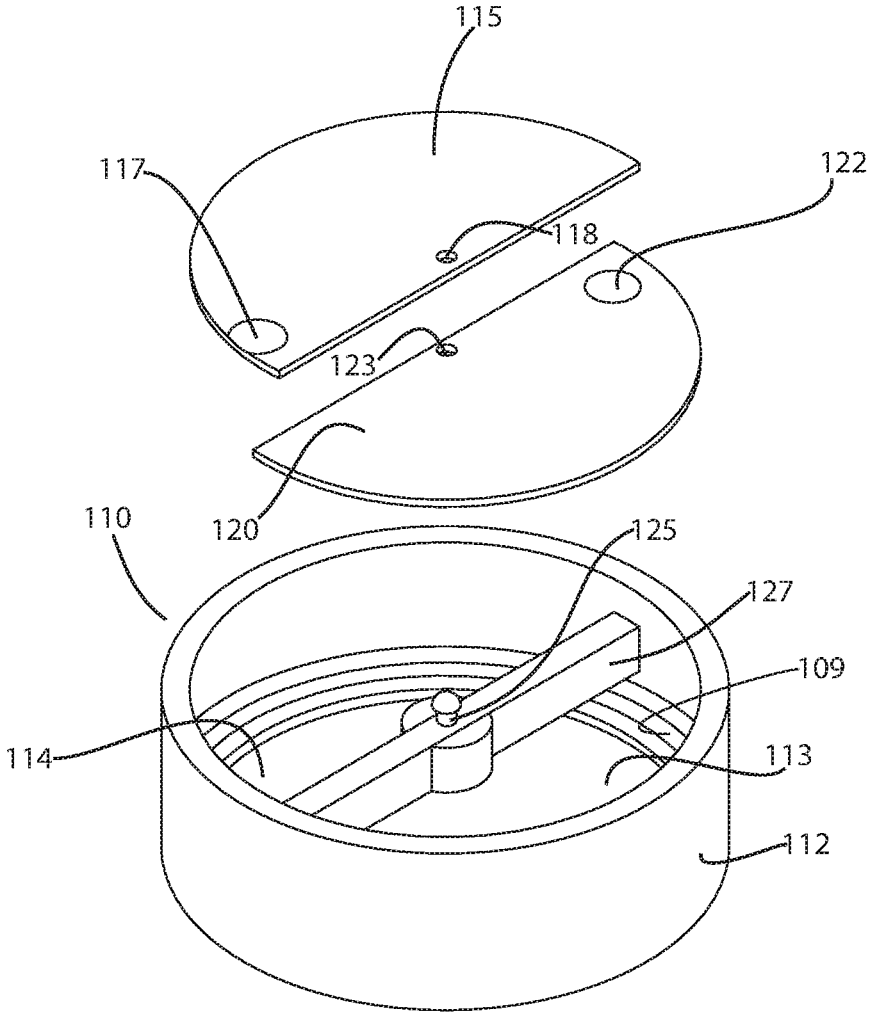
FIG. 7 is an exploded perspective view of an exemplary lid for a drinking vessel, according to principles of the invention.

A removable lid 110 is attached to the top of the outer cover 105, as shown in FIGS. 1, 2 and 3. The removable lid 110 includes threads 109 (FIGS. 6 and 7), for threadedly engaging mating threads 108 at the top of the outer cover 105. The lid 110 may have external or internal (as shown) threads. The top of the outer cover 105 may have mating internal or external (as shown) threads.

When the lid 110 is threaded onto the outer cover 105, one panel 120 covers the utensil compartment 145 and the other panel 115 covers the beverage compartment 130. A panel 115, 120 may fully or substantially cover a compartment 130, 145. In either case the case the panel 115, 120 covers the compartment. Both compartments 130, 145 are covered when both panels 115, 120 are closed. One compartment 130, 145 is fully or substantially exposed (i.e., uncovered) when the panel that had been covering that compartment has been moved to an open position. The lid is intended for exposing (i.e., uncovering) one compartment 130, 145 at a time, by moving the panel 115, 120 for that compartment to an open position. Alternatively, the lid 110 may be removed to fully expose both compartments 130, 145.

Each panel 115, 120 has approximately a semicircle cross-section shape. The radius, measured from the aperture 118, 123 of each panel to its outer edge, is about the same, or very slightly less, than the radius of the inner opening of lid 110. This configuration allows pivoting rotation of each panel 115, 120 about the pivot pin 125 extending through the aperture 118, 123 of the panel 115, 120, within the inner opening of lid 110.

Each panel may move (e.g., pivot) from a closed position to an open position. In a closed position, a panel covers its respective compartment. In an open position, the panel does not cover its respective compartment. Each panel includes an aperture 118, 123, through which a pivot pin 125 extends. The pivot pin 125 plugs into a cross bar 127 that extends across the rim 112 of the lid 110. The portions of the panels 115, 120 that overlay the cross bar 127, overlap each other. Thus, one panel 120 may pivot beneath the other panel 115, or vice versa. This arrangement allows each panel to move independently of the other panel. Fingertip recesses 117, 122 (e.g., semi-spherical indentations) may be formed in the top surface of each panel 115, 120 to facilitate manipulation. Such a lid 110 allows exposing the utensil compartment 145 to remove or insert utensils. Such a lid 110 also allows exposing the beverage compartment 130 for a user to consume a beverage. Such a lid 110 also allows removal (e.g., by unscrewing) of the lid 110 from the outer cover 105 to expose both compartments 130, 145 for cleaning, refilling or any other reason.

Figure 19:
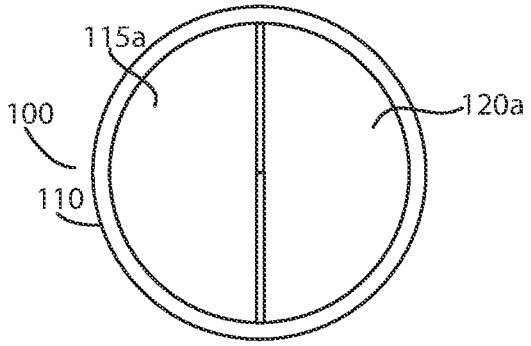
FIG. 19 is a plan view of an exemplary drinking vessel with hinged panels according to principles of the invention.
Figure 18:
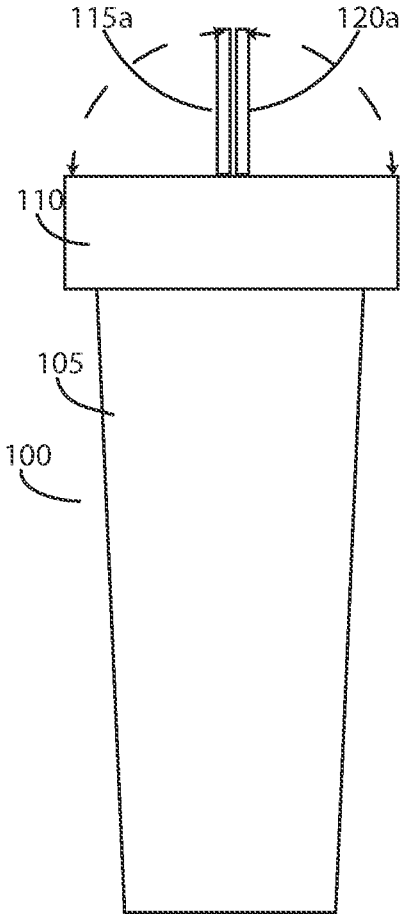
FIG. 18 is a side view of an exemplary drinking vessel with hinged panels according to principles of the invention.

The invention is not limited to the exemplary lid shown in FIGS. 1-3, 6, 7. A lid with hinged panels 115*a*, 120*a* may be utilized within the scope of the invention. Each hinged panel may flip from a closed (e.g., horizontal) position to an open position (e.g., vertical or folded over) 180°, as conceptually illustrated in FIGS. 18 and 19. Each hinged panel 115*a*, 120*a* may cover a compartment 130, 145. Additionally, the lid may be secured to the outer cover 105 with attachment means other than threads 108, 109. Such other means may include friction (e.g., press on) and key-slot coupling. Furthermore, the panels may be shaped like pie slices (i.e., an arc with a radius extending from each endpoint and converging at a point equidistant from each endpoint.

FIGS. 8 and 9 conceptually illustrate an exemplary drawer 200 comprised of a panel 215 and a top 220 (i.e., a top flange), a bottom 225 (i.e., a bottom flange), and a pair of sides 205, 210 extending from the panel 215 at an angle of 90° relative to the plane of the panel 215 (i.e., orthogonal to the plane of the panel 215) at the top, bottom and sides of the panel, respectively. The top 220 and bottom 225 are substantially parallel. The sides 205, 210 are substantially parallel to each other and orthogonal to the top 220 and bottom 225.

The panel 215 of the drawer 200 is sized to receive utensils. In the exemplary embodiment, the utensils include a spoon 245, fork 250, and knife 240. However, the invention is not limited to any particular utensils. Other utensils, such as, but not limited to, a straw, a spork (combination fork and spoon), a spife (combination spoon and knife), a spatula, and chopsticks, may be stored on the drawer 200 in addition to, or in lieu of, any of the utensils shown in FIGS. 8 and 9, without departing from the scope of the invention. The utensils may be comprised of any suitable material, including, without limitation, plastic or metal. In a preferred embodiment, the utensils are washable and reusable.

The drawer 200 includes retention elements for releasably securing the utensils to the panel 215 of the drawer 200. In FIGS. 8 and 9, the retention elements comprise a pair of upper slotted tabs 230 and slots 235 in the bottom 225 of the drawer. Bottom and top edges of the utensils are received in the slots of the upper slotted tabs 230 and in the slots 235 in the bottom 225. The distance between the upper slotted tabs 230 and in the slots 235 in the bottom 225 is slightly less than the overall lengths of the utensils. To receive the bottom and top edges of the utensils in the slots of the upper slotted tabs 230 and in the slots 235 in the bottom 225, the upper slotted tabs 230 and/or the bottom 225 are flexible plastic. By way of example, the upper slotted tabs 230 may be deflected to receive and release the engaged utensils. The upper slotted tabs 230 are below the top 220 of the drawer 200. The leaf spring 170 of the drawer stop 155, which exerts force against the top 220 of the drawer 200, could potentially dislodge the utensils if slots were formed in the top 220 of the drawer 200.

Retention elements other than upper slotted tabs 230 and slots 235 in the bottom 225 may be utilized without departing from the scope of the invention. Such other retention elements may include, snap fit retainers that extend from the panel 215 and grip the handles of utensils. As another example, magnets may be applied to the utensils and/or drawer to releasably retain utensils. As yet another example, the panel of the drawer may be equipped with molded pockets shaped to snugly receive each utensil. These and other retention elements may be used without departing from the scope of the invention.

The stored utensils extend outwardly from the panel 215 of the drawer 200 a distance that is determined by the thickness and shape of the utensils. This distance is preferably less than the maximum distance by which the top 220 and bottom 225 extend from the panel 215. Thus, the panel 215, top 220 and bottom 225 keep the stored utensils from contacting the interior walls of the outer cover 105 in the utensil compartment 145 when the drawer 200 is in the compartment 145. This configuration helps reduce soiling the interior walls of the outer cover 105 in the utensil compartment 145 by used utensils stored in the drawer 200. A user may fully clean utensils immediately after use, or wipe utensils with a napkin and clean them fully later, or store the used utensils, uncleaned, in the drawer 200 for fully cleaning later. Regardless of which approach a user takes, the configuration of the drawer 200 helps maintain cleanliness of the compartment 145.

A drinking vessel assembly according to principles of the invention is assembled by inserting the cup 135 with the drawer stop 155 into the cover 105 from the top 106 of the cover 105. The panel 120 is pivoted to the open position. The drawer 200 containing utensils 240-250 is slid through the opening 113 in the lid 110 into the compartment 145, until the bottom 225 contacts the drawer stop 155 compresses the leaf spring 170 and can move no further. Then the panel 120 is pivoted to the closed position.

To remove utensils, the panel 120 is pivoted to the open position. The leaf spring 170 urges the drawer 200 away from the drawer stop 155 until the leaf spring is fully uncompressed. This causes the top portion of the drawer 200 to extend out from the opening 113 in the lid 110. The user may grab the portion of the drawer 200 extending outwardly and pull the drawer 200 from the compartment 145. Then utensils 240-250 may be removed from the drawer as desired. The drinking vessel may be used with the drawer 200 removed from or contained in the compartment 145. The drinking vessel may be used with the drawer 200 removed and the lid 110 off the outer cover 105. The drinking vessel may be used with the drawer 200 contained in the compartment and the panel 120 in the closed position.

To replace utensils after cleaning or use, the panel 120 is pivoted to the open position. If the drawer 200 is contained in the compartment 145, the leaf spring 170 urges the drawer 200 away from the drawer stop 155 until the leaf spring is fully uncompressed. This causes the top portion of the drawer 200 to extend out from the opening 113 in the lid 110. The user may grab the portion of the drawer 200 extending outwardly and pull the drawer 200 from the compartment 145. Then utensils 240-250 may be inserted into the drawer as desired. The drawer 200 containing utensils 240-250 is then slid through the opening 113 into the compartment 145, until the bottom 225 contacts the drawer stop 155 compresses the leaf spring 170 and can move no further. Then the panel 120 is pivoted to the closed position.

Figure 16:
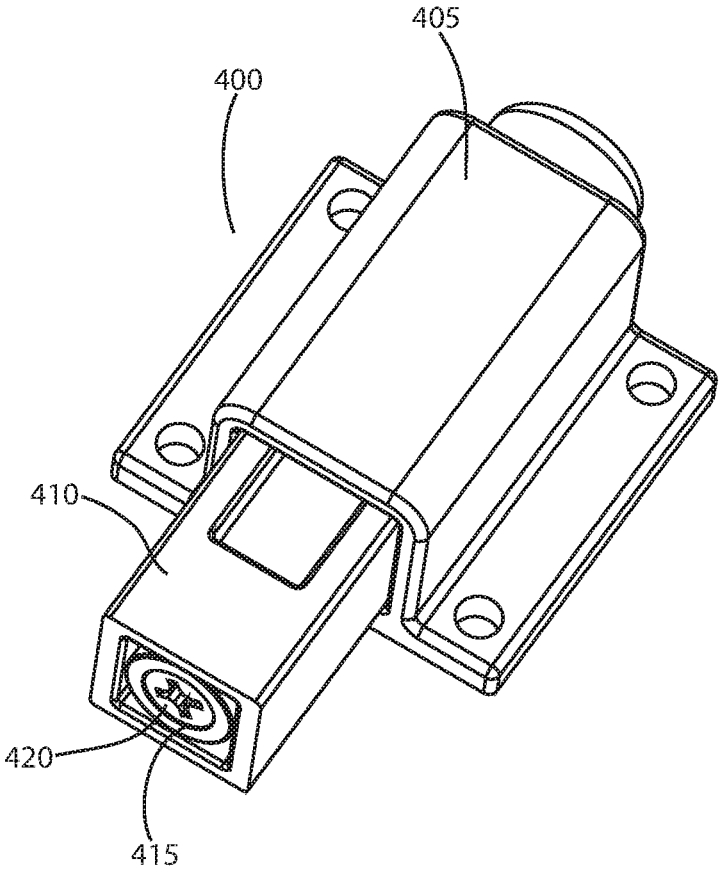
FIG. 16 is a perspective view of an exemplary drawer stop assembly according to principles of the invention.
Figure 17:
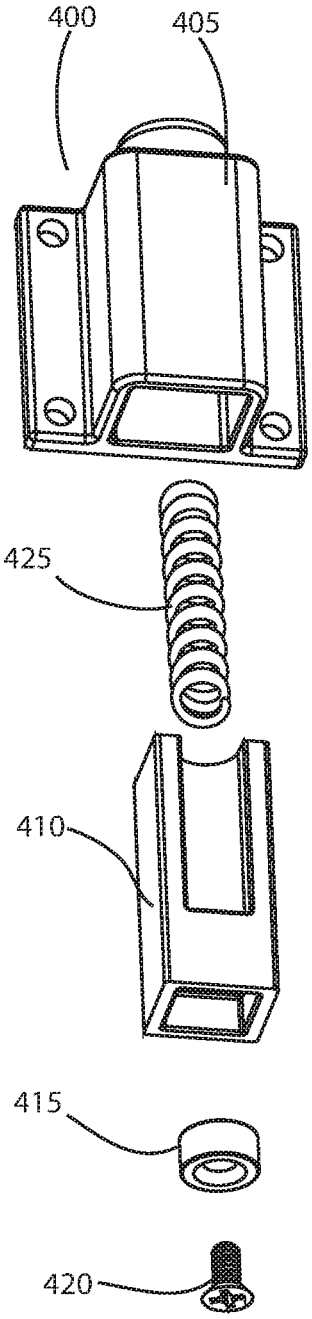
FIG. 17 is a perspective exploded view of an exemplary drawer stop assembly according to principles of the invention.

With reference to FIGS. 16 and 17, an alternative drawer stop 400 may comprise a plunger 410, a housing 405 and a spring 425. The spring 425 is a compression spring contained in the housing 405. The spring 425 urges the plunger 410 to an extended position. A bushing 415 is secured to the exposed end of the plunger 410 by a screw. Force applied by pushing the drawer 200 to a stored position causes the plunger 410 to retract into the housing 405 and compress the spring 425. Embodiments of the drawer stop may include internal catch and release latches to hold the plunger 410 in a retracted position in the housing 405 until the latch(es) is(are) released by further retracting the plunger 410.

Figure 11:
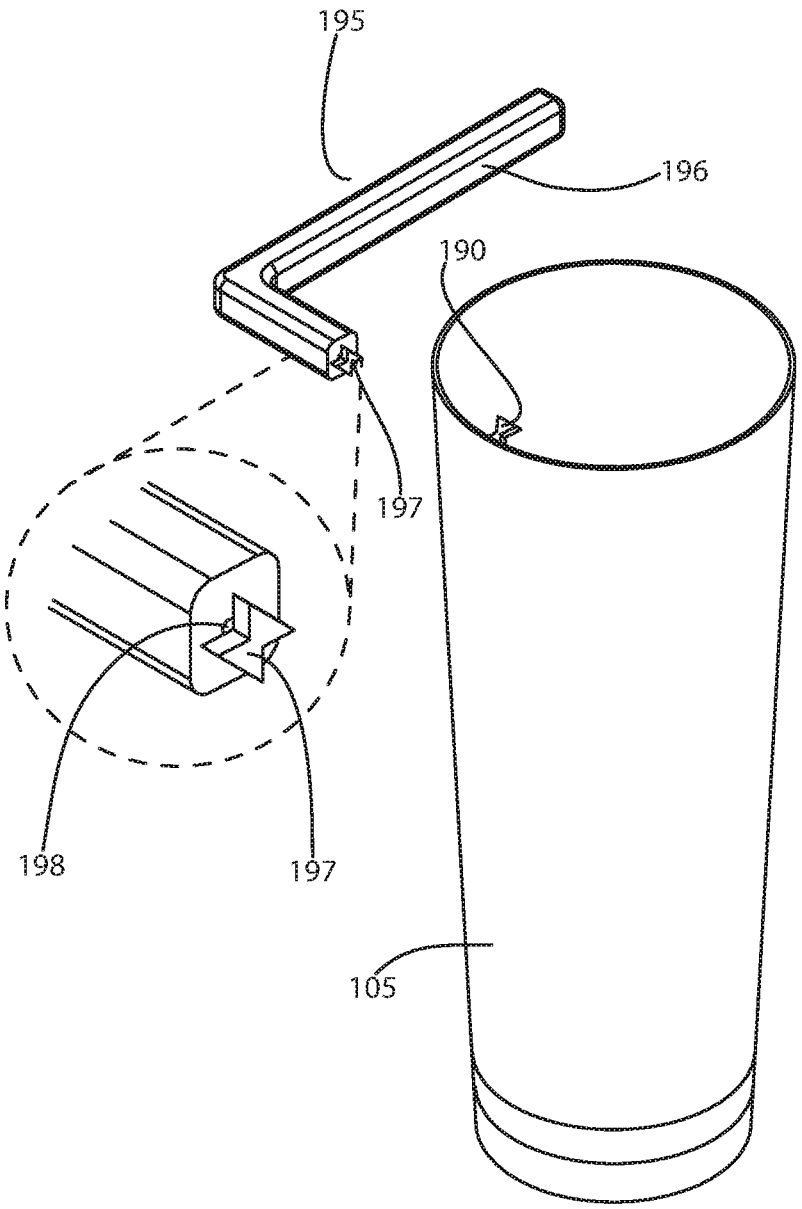
FIG. 11 is a second perspective view of an outer cover with a removable handle for a drinking vessel according to principles of the invention.
Figure 12:
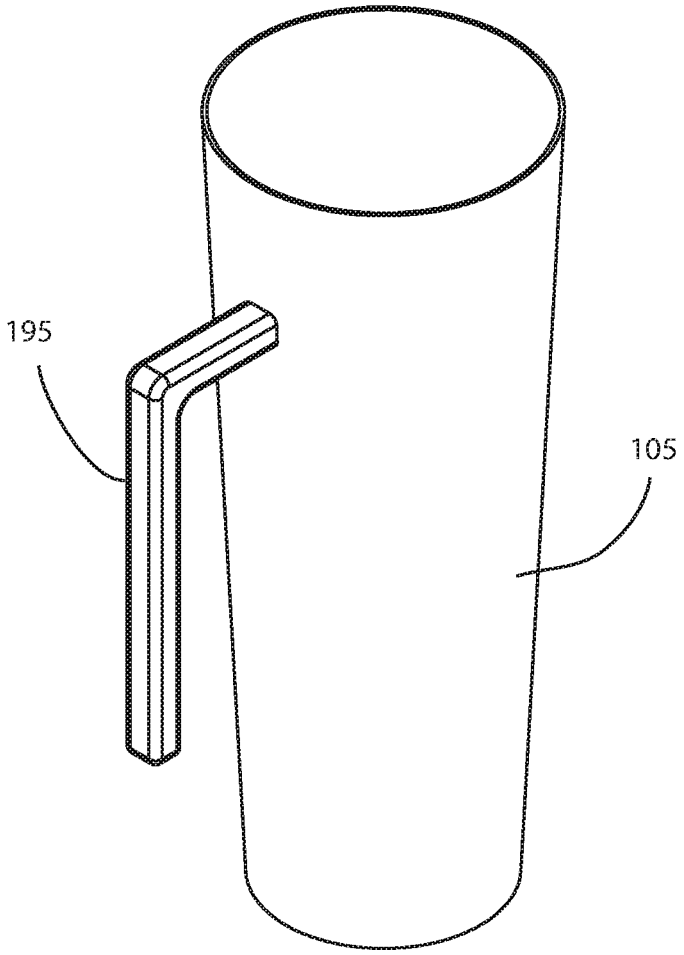
FIG. 12 is a third perspective view of an outer cover with a removable handle for a drinking vessel according to principles of the invention.

Referring to FIGS. 10-12, an embodiment of the outer cover 105 with a removable handle 195 is conceptually illustrated. The handle 195 may be removed to facilitate storage of the drinking vessel in a cup holder, such as a cup holder of a vehicle. The handle 195 includes a grip 196 and a handle plug 197 that mates with an aperture 190 in the outer cover 105. The handle plug 197 has a cross-section shape that is not circular. The handle plug 197 fits into the aperture 190, only when the handle 195 is oriented for insertion. After such insertion, the handle may be rotated 90°. Upon such rotation, the handle plug 197 cannot be dislodged from the aperture 190. A shank 198 connects the handle plug 197 to the handle grip 196. The length of the shank 198 is about the thickness of the outer cover 105 at the aperture 190, or only slightly greater than the thickness. The diameter or maximum width of the shank is less than the width of the aperture 190, to allow pivoting rotation of the handle 195. The handle 195 may be removed by pivoting the handle to the insertion position, so that the handle plug 197 aligns with the aperture 190. Upon such alignment, the handle plug 197 may be withdrawn from the aperture 190.

Figure 13:
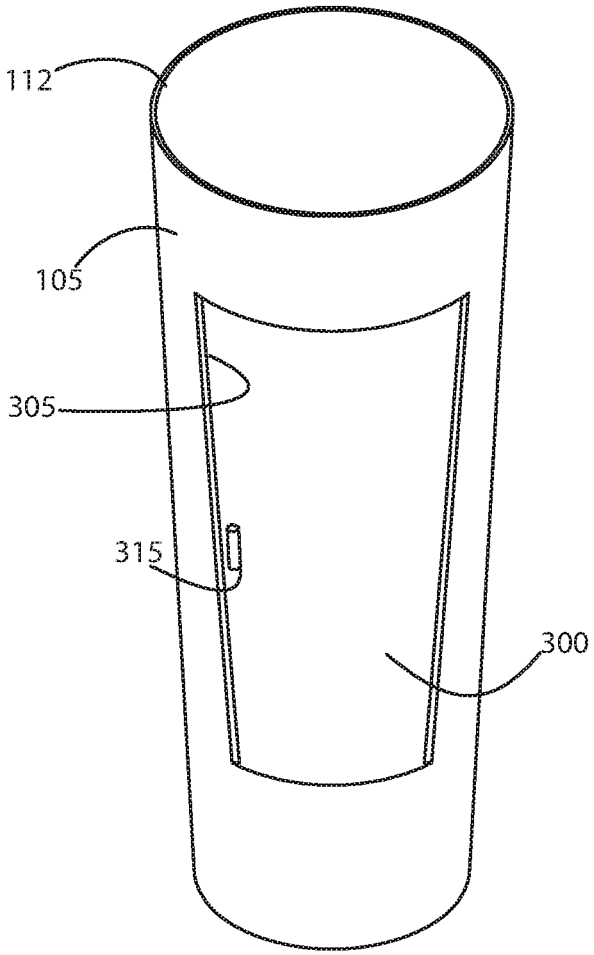
FIG. 13 is a first perspective view of an outer cover with a sliding door according to principles of the invention.
Figure 14:
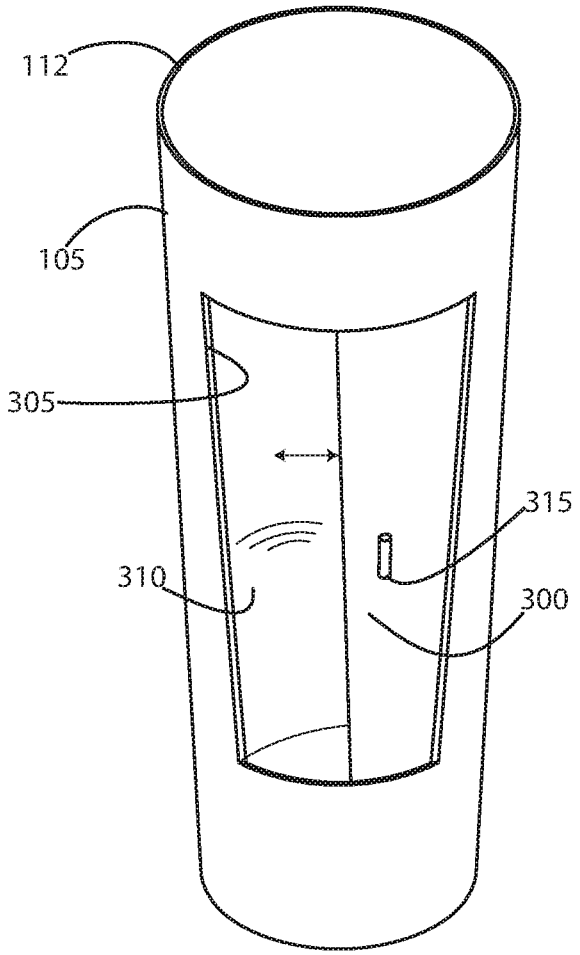
FIG. 14 is a second perspective view of an outer cover with a sliding door according to principles of the invention.
Figure 15:
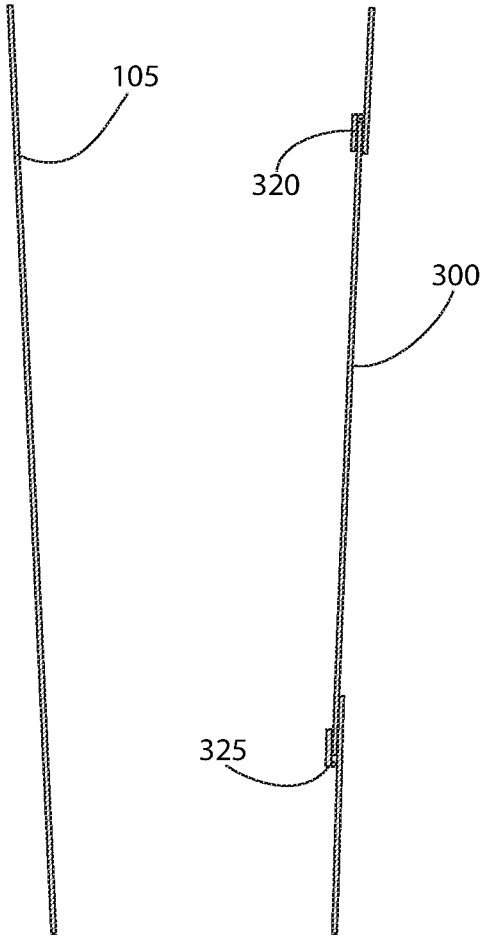
FIG. 15 is a cross-section view of an outer cover with a sliding door according to principles of the invention.

Referring to FIGS. 13-15, an alternative embodiment with a sliding door 300 is conceptually illustrated. The outer housing 105 includes a doorway 305. A door 300 covers the doorway 305 when the door 300 is slid into the closed position, as conceptually illustrated in FIG. 13. The door 300 may be opened by sliding motion. As the door 300 has substantially the same contour as the portion of the outer housing 105 with the doorway 305, the door 300 may slide and abut the inner side of the outer cover 105. When the door 300 is slid into the open position as shown in FIG. 14, a compartment 310 is revealed, which may house the drawer 200 and utensils. The door 300 is retained against the inner side of the outer cover 105 by a pair of tracks, i.e., upper track 320 and lower track 325, which are conceptually illustrated in the cross-section view of FIG. 15. A protuberance 315, fingertip recess or knurled portion facilitates fingertip grip to slide the door 300 for opening and closing. The protuberance 315 also limits the range of movement of the door. Detents and other door stops may be used to indicate and register closed or open configurations.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A drinking vessel assembly comprising:

a cup having an open top leading to a space for containing a liquid, a bottom, a recessed side extending from the open top to a transition between the top and the bottom;

a cover with a circular cross-section shape, the cover including an open top, a bottom and an interior space extending from the open top to the bottom, the cover being sized and shaped to receive and contain the cup;

the cover and the recessed side of the cup defining a utensil compartment extending from the open top of the cup to the transition;

a drawer, the drawer being sized and shaped to slide into and be contained within the utensil compartment;

a removable lid on the open top of the cover; and at least one utensil in the utensil compartment.

2. The drinking vessel assembly according to claim 1, the utensil compartment having a D-shaped cross-section.

3. The drinking vessel assembly according to claim 1, the at least one utensil comprising at least one utensil releasably attached to the drawer.

4. The drinking vessel assembly according to claim 3, the at least one utensil comprising at least one utensil from the group consisting of a fork, a spoon, a knife, a straw and a pair of chopsticks.

5. The drinking vessel assembly according to claim 3, further comprising a plurality of attachments, including a slotted flexible tab, releasably attaching the at least one utensil to the drawer.

6. The drinking vessel assembly according to claim 1, the drawer including a drawer panel having a top end and a bottom end, a top flange extending orthogonally from the top end of the drawer panel, and a bottom flange extending orthogonally from the bottom end of the drawer panel.

7. The drinking vessel assembly according to claim 6, the drawer further including a pair of side flanges, the side flanges being perpendicular to the top flange and the bottom flange.

8. The drinking vessel assembly according to claim 1, further comprising a drawer stop attached to the recessed side of the cup between the open top of the cup and the transition, adjacent to the transition, the drawer stop comprising a structure that impedes insertion of the drawer beyond the drawer stop.

9. The drinking vessel assembly according to claim 8, the drawer stop further comprising a spring extending from the drawer stop towards the open top of the cup.

10. The drinking vessel assembly according to claim 9, the spring comprising a compression spring.

11. The drinking vessel assembly according to claim 9, the drawer stop comprising a vertical panel and a horizontal panel extending perpendicular from the vertical panel.

12. The drinking vessel assembly according to claim 11, the spring comprising a compression spring, and the compression spring being integrally formed with the horizontal panel.

13. The drinking vessel assembly according to claim 1, the removable lid including a first panel and a second panel, the first panel being movable from a closed position to an open position, and in the open position the first panel exposing the space for containing the liquid, and in the closed position the first panel covering the space for containing the liquid, the second panel being movable from a closed position to an open position, and in the open position the second panel exposing the utensil compartment, and in the closed position the second panel covering the utensil compartment.

14. The drinking vessel assembly according to claim 13, the first panel comprising a first pivoting panel and the second panel comprising a second pivoting panel, the first pivoting panel being movable by pivoting in a first plane, and the second pivoting panel being movable by pivoting in a second plane, the first plane being parallel to the second plane and spaced apart from but adjacent to the second plane.

15. The drinking vessel assembly according to claim 13, the first panel comprising a first hinged panel and the second panel comprising a second hinged panel, the first hinged panel being movable by pivoting from a horizontal orientation to a vertical orientation, the second hinged panel being movable by pivoting from a horizontal orientation to a vertical orientation.

16. The drinking vessel assembly according to claim 1, further comprising threads removably securing the lid to the cover.

17. The drinking vessel assembly according to claim 16, the threads comprising external threads on the cover and mating internal threads on the lid.

* * * * *